US009010912B2

(12) United States Patent
Ichimura et al.

(10) Patent No.: US 9,010,912 B2
(45) Date of Patent: Apr. 21, 2015

(54) PRINTER CONTROL DEVICE, PRINTING SYSTEM, METHOD FOR CONTROLLING PRINTER AND RECORDING MEDIUM

(75) Inventors: Minoru Ichimura, Matsumoto (JP); Daisuke Nagai, Matsumoto (JP); Masaharu Iwatani, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 542 days.

(21) Appl. No.: 13/272,089

(22) Filed: Oct. 12, 2011

(65) Prior Publication Data

US 2012/0092716 A1 Apr. 19, 2012

(30) Foreign Application Priority Data

Oct. 14, 2010 (JP) ..... 2010-231417

(51) Int. Cl.
*B41J 2/175* (2006.01)
*B41J 2/165* (2006.01)

(52) U.S. Cl.
CPC ..... *B41J 2/16532* (2013.01); *B41J 2/16505* (2013.01); *B41J 2/17509* (2013.01); *B41J 2/17566* (2013.01)

(58) Field of Classification Search
USPC ..... 347/5, 7, 19, 84–87; 358/1.15
See application file for complete search history.

(56) References Cited

U.S. PATENT DOCUMENTS

| | | | | |
|---|---|---|---|---|
| 6,460,982 | B1 | 10/2002 | Ito et al. | |
| 6,851,797 | B2 * | 2/2005 | Suda et al. | 347/85 |
| 7,470,007 | B2 * | 12/2008 | Silverbrook et al. | 347/84 |
| 8,346,103 | B2 * | 1/2013 | Abe | 399/12 |
| 8,485,622 | B2 * | 7/2013 | Ogasawara et al. | 347/7 |
| 2004/0153651 | A1 | 8/2004 | Iida | |

FOREIGN PATENT DOCUMENTS

| | | | |
|---|---|---|---|
| JP | 2000-211155 | A | 8/2000 |
| JP | 2004-074464 | A | 3/2004 |
| JP | 2008-268454 | A | 11/2008 |
| JP | 2008-296535 | A | 12/2008 |

* cited by examiner

*Primary Examiner* — Anh T. N. Vo
(74) *Attorney, Agent, or Firm* — Kilpatrick Townsend & Stockton LLP

(57) ABSTRACT

A printer driver that controls operations of an ink jet printer which is capable of being refilled with ink from the outside, causes a computer to execute an acquiring function of acquiring attribute information on a destination country or region where the ink jet printer is to be used, an input function of allowing an ink ID number which is assigned to the ink that is to be refilled to be entered, an ink determining function of determining whether the ink is genuine or not by analyzing the ink ID number which has been entered, a selection/execution function of selecting one of a plurality of processes for a non-genuine ink on the basis of the attribute information, if the ink is determined to be not genuine and executing the selected process.

7 Claims, 7 Drawing Sheets

PRINTER CONTROL DEVICE, PRINTING SYSTEM, METHOD FOR CONTROLLING PRINTER AND RECORDING MEDIUM

CROSS REFERENCES TO RELATED APPLICATIONS

The entire disclosure of Japanese Patent Application No. 2010-231417, filed Oct. 14, 2010 is expressly incorporated by reference herein.

BACKGROUND

1. Technical Field

The present invention relates to printer control devices, printing systems, a method for controlling a printer, and recording mediums.

2. Related Art

Printing apparatuses such as an ink jet printer that perform printing of images by ejecting ink from an ejecting head are commonly used. The ink to be ejected is contained in a specialized container called an ink cartridge and supplied to the ejecting head by using the weight of ink itself or by means of a liquid pump.

The ejecting head has a complicated internal configuration in which fine ejecting nozzles for ejecting ink and narrow ink passages for guiding ink to the ejecting nozzles are formed. Such ejecting nozzles or the ink passages may be clogged when ink with a decreased quality is supplied, which may eventually lead to a need to replace the ejecting head. Therefore, when ink runs out, the whole ink cartridge is replaced with a new one, thereby preventing ink with a decreased quality from being supplied. In this manner, a new ink cartridge is loaded when ink runs out. In addition, ink in the ink cartridge remains in an appropriate condition for a long period of time prior to the ink cartridge being loaded. This makes it possible to constantly supply ink in an appropriate condition to the ejecting head.

However, the amount of ink that can be contained in the ink cartridge is limited. Thus, when a large amount of printing is executed, the printing job must be suspended several times during printing to replace the ink cartridges. JP-A-2000-211155 discloses a technique to perform continuous printing by supplying ink from an ink tank which is mounted in a printing apparatus and, when ink is running short during printing, injecting a refill ink from an ink bottle which is separately provided.

Such a printing apparatus can be connected to a computer and operated from the computer. In this case, a user installs a printer driver that is compatible with the printing apparatus into the computer. The installed printer driver generates a printing job of images to be printed and sends the printing job to the printing apparatus. Further, since the printer driver can manage the remaining amount of ink in the ink tank and control the refilling of ink, a user can supply ink to the printing apparatus in accordance with a user interface displayed on the computer.

Such printing apparatuses are shipped to different destinations such as countries or regions. Accordingly, different printer drivers have been supplied since available functions may be different depending on the destination country or region of the printing apparatus and a user has to obtain an appropriate printer driver and install the printer driver into the computer.

The suppliers of such printing apparatuses need to manufacture and supply different printer drivers depending on the destination country or region of the printing apparatus. When the printing apparatuses are supplied to a large number of destinations, printer drivers for the respective destinations must be manufactured and managed, which requires a significant amount of labor and cost.

SUMMARY

An advantage of some aspects of the invention is that the labor and cost required for management of printer drivers is reduced.

According to aspects of the invention, the following embodiment or applied examples can be achieved.

Applied Example 1

According to an aspect of the invention, the following is provided: a printer control device that controls operations of a printing apparatus which is capable of being refilled with ink from the outside including an acquiring function of acquiring attribute information on a destination country or region where the printing apparatus is used, an input function of allowing an ink identification code which is assigned to the ink that is to be refilled to be entered, an ink determining function of determining whether the ink is genuine or not by analyzing the ink identification code which has been entered, and a selection/execution function of selecting one of a plurality of processes for a non-genuine ink on the basis of the attribute information if the ink is determined to be not genuine and executing the selected process.

With these functions, the attribute information on the destination country or region of the printing apparatus can be acquired, and, if the ink is determined to be not genuine, one of the processes for a non-genuine ink can be selected on the basis of the attribute information. Accordingly, one printer control device can be applied to printing apparatuses for a plurality of destination countries or regions. Therefore, efforts to provide different printer control devices depending on the destination country or region of the printing apparatus and costs of manufacturing printer control devices can be reduced.

Applied Example 2

According to the printer control device of the applied example 1, the selection/execution function preferably determines whether a genuine ink is necessary or not on the basis of the attribute information, requests a user to re-enter the ink identification code if a genuine ink is determined to be necessary, and provides a notification that the ink to be refilled is not genuine if it is determined a genuine ink is not necessary.

With these functions, one of two processes for a non-genuine ink can be selected and executed on the basis of the attribute information.

Applied Example 3

According to the printer control device of the applied example 1, the selection/execution function preferably determines whether the ink identification code is to be re-entered or not if a genuine ink is determined to be unnecessary, and provides a notification that printing with a non-genuine ink may decrease printing quality if the ink identification code is not re-entered.

With these functions, if a genuine ink is not necessary and the ink identification code is not re-entered, a notification can be provided to the user that printing with a non-genuine ink may decrease printing quality.

Applied Example 4

The printer control device of the applied example 1 preferably further includes an encryption determining function of determining whether the ink identification code which is entered has been encrypted or not on the basis of the attribute information, and a decrypting function of decrypting the ink identification code to be analyzable if it is determined that the ink identification code has been encrypted.

With these functions, whether the ink identification code is encrypted or not can be determined on the basis of the attribute information, and if encrypted, the encrypted ink identification code can be decrypted.

Applied Example 5

According another aspect of the invention, the following is provided: a printing system including a printing section which is capable of performing refilling of ink from the outside and a control section that controls operations of a printing apparatus, the printing section and the control section are communicatively connected with each other. The printing section has a holding unit that holds attribute information on a destination country or region where the printing apparatus is to be used, and a transmission unit that transmits the attribute information to the control section. The control section has a receiving unit that receives the attribute information sent from the printing section, an input unit that allows the ink identification code which is assigned to the ink that is to be refilled to be entered, an ink determining unit that determines whether the ink is genuine or not by analyzing the ink identification code which has been entered, and a selection/execution unit that selects one of a plurality of processes for a non-genuine ink on the basis of the attribute information if the ink is determined to be not genuine and executes the selected process.

With this configuration, the attribute information on the destination country or region of the printing apparatus can be acquired, and, if the ink is determined to be not genuine, one of the plurality of processes for a non-genuine ink can be selected on the basis of the attribute information. Accordingly, one printer control device can be applied to printing apparatuses for a plurality of destination countries or regions. Therefore, efforts to provide different printer control devices depending on the destination country or region of the printing apparatus and costs of manufacturing printer control devices can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described below with reference to the accompanying drawings.

Embodiment

Figure 1:
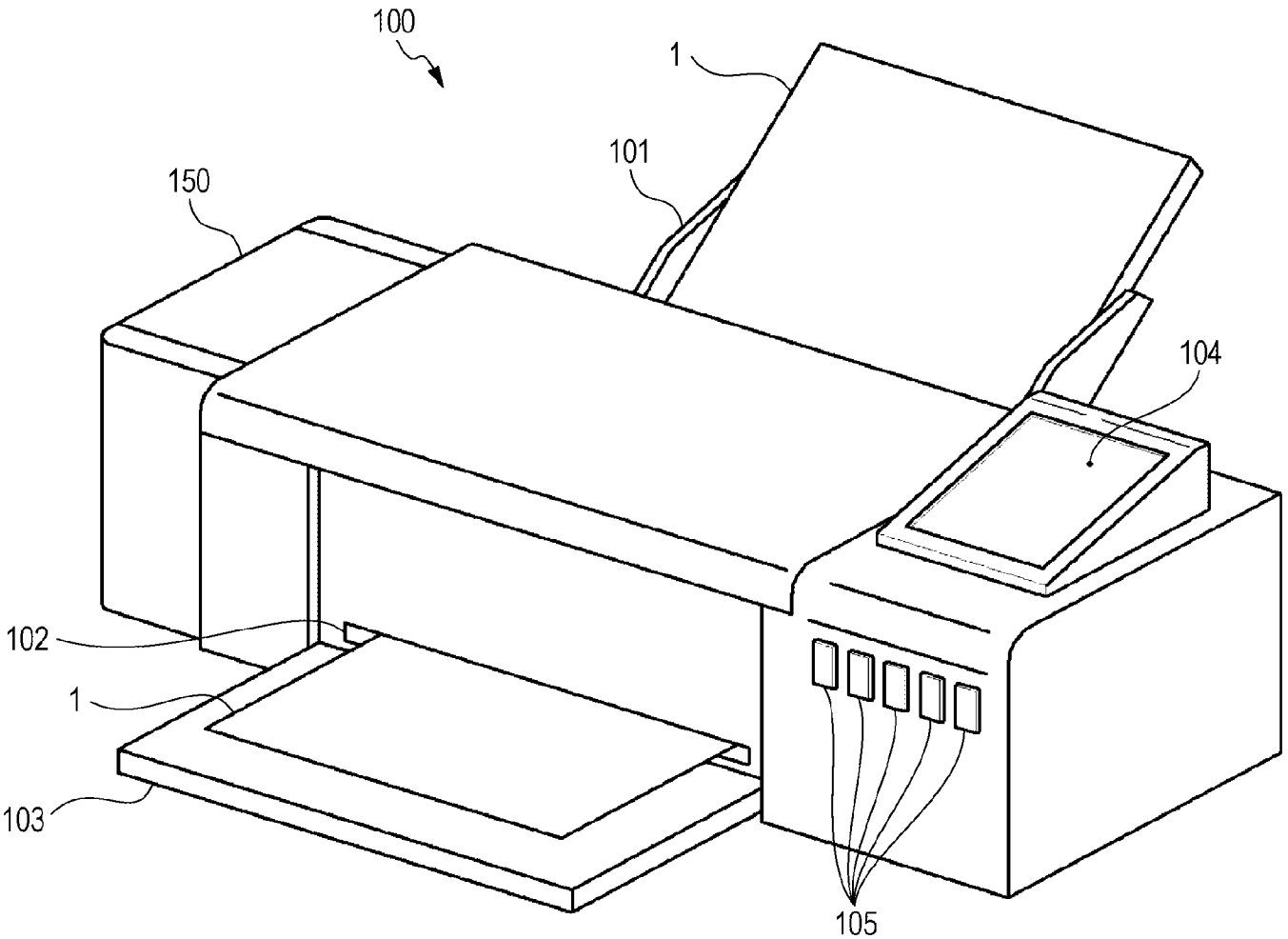
FIG. 1 illustrates an ink jet printer as a printing apparatus according to an embodiment of the invention.

FIG. 1 illustrates an ink jet printer 100 as an exemplary printing apparatus according to an embodiment. As illustrated in the figure, the ink jet printer 100 has a substantially box-shaped appearance and includes a front cover 103 at an approximate center of the front side and a feeding paper tray 101 on the back side on which a print sheet 1 is placed. A plurality of operation buttons 105 are arranged on the front side of the ink jet printer 100 at a position which is next to the front cover 103. Further, a touch-panel type monitor display 104 is disposed on top of the ink jet printer 100 on the side where the operation buttons 105 are arranged. The front cover 103 is pivotally supported at the lower end thereof and configured to be capable of being flipped down to uncover an elongated paper output port 102 through which print paper 1 is output. After the print paper 1 is placed on the feeding paper tray 101, the display 104 or the operation buttons 105 are operated so that the print paper 1 is advanced into the ink jet printer 100 from the feeding paper tray 101. The print paper 1 undergoes printing of images inside the ink jet printer 100 and is output through the paper output port 102.

A box-shaped tank case 150 is attached on the side face of the ink jet printer 100. As described later in detail, two or more ink tanks 151 are housed in the tank case 150 such that ink used for printing by the ink jet printer 100 is supplied from the ink tanks 151.

Figure 2:
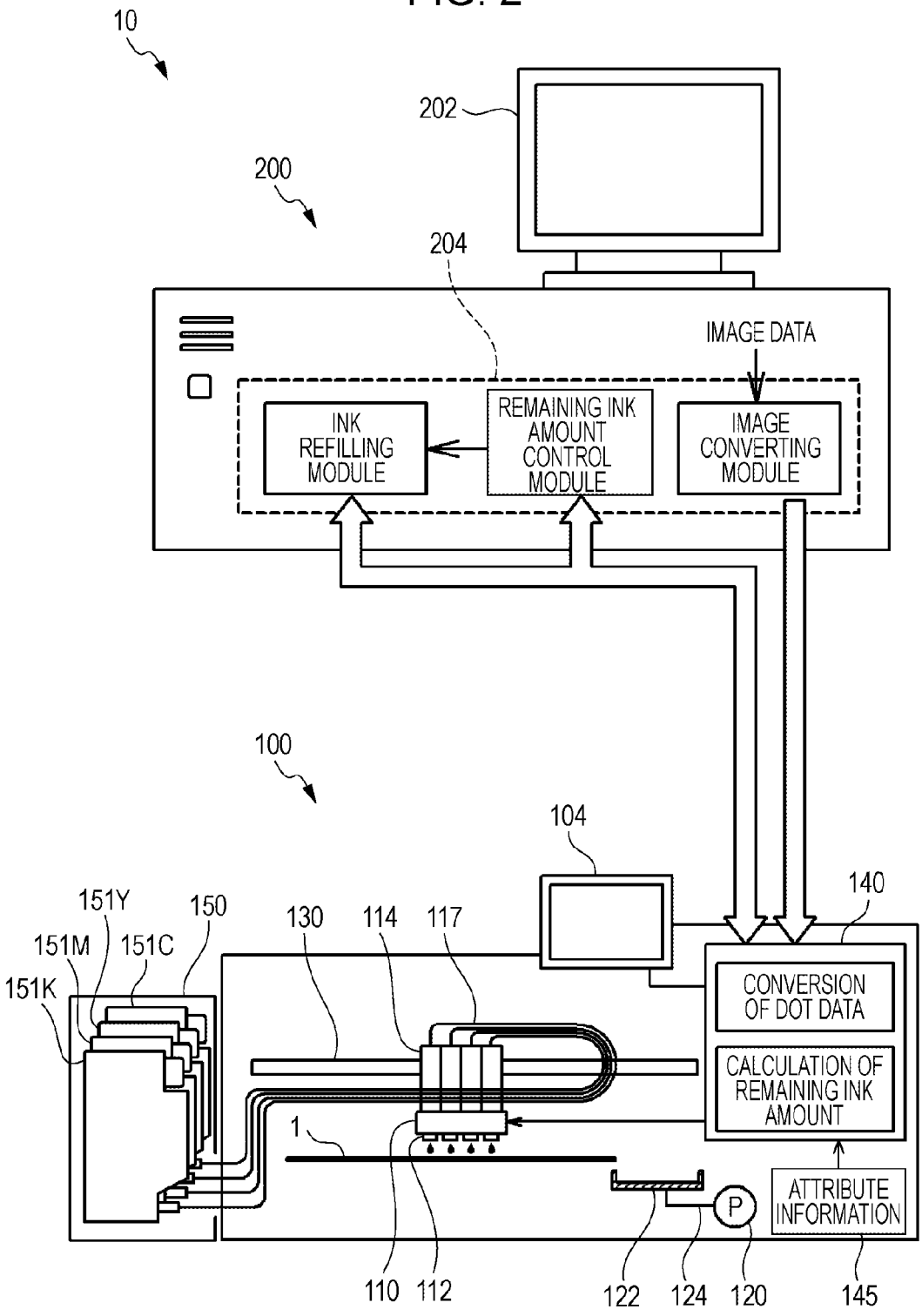
FIG. 2 illustrates an overall configuration of a printing system of this embodiment.

FIG. 2 illustrates an overall configuration of a printing system 10 of this embodiment. The printing system 10 includes a computer 200 that serves as a control section and the ink jet printer 100 that serves as a printing section, both of which are communicatively connected via a USB, for example.

First, the internal configuration of the ink jet printer 100 will be briefly described. As illustrated in FIG. 2, a carriage 110 that reciprocates above the print paper 1 is disposed inside the ink jet printer 100. The carriage 110 is provided with ejecting heads 112 through which ink is ejected. The ink jet printer 100 of this embodiment is capable of printing images using four colors, namely, cyan (hereinafter, C), yellow (hereinafter, Y), magenta (hereinafter, M) and black (hereinafter, K), such that ejecting heads 112 are provided for each of the ink colors.

The carriage 110 is driven by a drive mechanism (not illustrated in the figure) to repeatedly reciprocate above the print paper 1 while being guided along a guide rail 130. As the carriage 110 moves in a reciprocating manner, the print paper 1 is gradually fed by a paper feeding mechanism which is also provided in the ink jet printer 100 (not illustrated in the figure). In accordance with the reciprocating movement of the carriage 110 and feeding of the print paper 1, any of C color ink (hereinafter, C ink), Y color ink (hereinafter, Y ink), M color ink (hereinafter, M ink) and K color ink (hereinafter, K ink) is ejected from the ejecting heads 112 so that images are printed on the print paper 1.

The ink to be ejected from the ejecting heads 112 is contained in the ink tanks 151 which are housed in the tank case 150. Since the ink jet printer 100 of this embodiment uses four types of ink, C ink, Y ink, M ink and K ink, the ink tanks 151 are accordingly provided for each of the ink types, that is, four ink tanks 151, namely, an ink tank 151C for C ink, an ink tank 151Y for Y ink, an ink tank 151M for M ink and an ink tank 151K for K ink are provided. In the description herein, the ink tanks 151C, 151Y, 151M and 151K may be collectively referred to as the ink tanks 151, as long as the ink types do not have to be specifically identified. The ink in the ink tanks 151 is supplied to the respective ejecting heads 112 via ink tubes 117 which are disposed for each of the ink types.

Further, a home position is provided at the position where the carriage 110 stays after having moved along the guide rail 130 in an area outside the print paper 1. The carriage 110 rests at the home position when the ink jet printer 100 is not performing a printing operation. In addition, a cap 122 is disposed at the home position and configured to be movable in the up-down direction by means of a lifting mechanism, which is not illustrated in the figure. When the carriage 110 is at the home position, the cap 122 is pressed against the bottom of the carriage 110. Then, a closed space is formed so as to enclose the ejecting head 112, thereby preventing the ink in the ejecting head 112 from drying. Further, the cap 122 is connected with a negative pressure pump 120 via a negative pressure tube 124. When the negative pressure pump 120 is actuated while the cap 122 is pressed against the bottom of the carriage 110, the ink inside the ejecting head 112 can be suctioned out. Accordingly, even if the ink inside the ejecting head 112 is dried and increases in viscosity, such ink can be suctioned out so that ink inside the ejecting head 112 can be maintained at an appropriate viscosity.

The ink jet printer 100 further includes a control section 140 which is composed of a CPU that performs logical operations and arithmetical operations, a ROM for storing various programs and data and a RAM for temporarily storing data by the CPU, all of which are not illustrated in the figure. On receiving the post-processing image data from the computer 200, the control section 140 converts the image data into image data which form the images by ink dots (dot data). Then, according to the dot data, the control section 140 controls reciprocating movement of the carriage 110, feeding of the print paper 1 and operation of the ejecting head 112 ejecting ink and forming ink dots. As the ink dots are formed, ink is consumed and the remaining amount of ink in the ink tanks 151 decreases accordingly. The control section 140 of this embodiment calculates the remaining amount of ink in each ink tank 151 on the basis of the dot data for each of the ink types and suspends the operation of the ejecting head 112 to eject ink when the remaining amount of ink reaches a predetermined lower limit (when ink runs out). This configuration can prevent the ejecting head 112 from receiving a significant amount of damage which is caused by driving the ejecting head 112 without supplying ink. Moreover, the ink jet printer 100 further includes a transmitting unit and a receiving unit, which are not illustrated in the figure, that respectively transmit and receive information to and from the computer 200. The ink jet printer 100 also includes a holding unit, which is not illustrated in the figure, that holds attribute information 145 such as destination information on the countries or regions where the ink jet printer 100 is to be shipped and identification information which is added by the manufacturer. In this embodiment, the attribute information 145 is pre-stored in the ROM or the like and sent from the transmitting unit to the computer 200 as necessary.

The computer 200 is configured such that the CPU, the ROM, the RAM and external storage devices such as a hard disk, all of which are not illustrated in the figure, are communicatively connected with each other for data transmission via a bus, and executes various programs stored in the external storage device or the ROM. Further, the computer 200 also includes a monitor display 202. A program which is called a printer driver 204 is included in a plurality of programs stored in the external storage device or the ROM. When the CPU executes the printer driver 204, predetermined image processing is performed on the image data of the images to be printed and output to the ink jet printer 100. Further, the computer 200 includes a transmitting unit and a receiving unit (not illustrated in the figure) that respectively transmit and receive information to and from the ink jet printer 100.

The operations of the printer driver 204 of this embodiment can be divided into three groups in accordance with their functions. That is, a group associated with a function of performing image processing on the image data (image converting module), a group associated with a function of controlling the remaining amount of ink in the ink tank 151 while communicating with the ink jet printer 100 (remaining ink amount control module) and a group associated with a function of refilling the ink tank 151 with ink when actuated by the remaining ink amount control module (ink refilling module). It should be noted that the term "module" as used herein is a virtual concept to simply divide the operations of the printer driver 204 in accordance with their functions, which can be embodied in various forms. For example, the modules can be embodied as a group of program codes composed of a plurality of commands in order to achieve a desired function when cooperating with a hardware device, or alternatively, embodied as a group of LSIs that achieves a desired function in the form of a hardware device. In addition, the printer driver 204 holds the attribute information 145 which is sent from the ink jet printer 100 so as to be referenced as necessary.

The image converting module, as mentioned above, performs predetermined image processing on the image data of the images to be printed so as to generate a print job and sends the generated print job to the ink jet printer 100. Since the processing and sending is a known technique, it will not be further described. The remaining ink amount control module performs a remaining ink amount control process, which is well known, while communicating with the ink jet printer 100 for data transmission, thereby preventing the ink jet printer 100 from failing to print due to ink running out. Further, the ink refilling module includes an ink determining unit that determines whether the ink to be refilled is genuine or not and a selection/execution unit that selects one of processes for a non-genuine ink according to the attribute information 145 and executes the selected process if the ink is not genuine.

Figure 3:
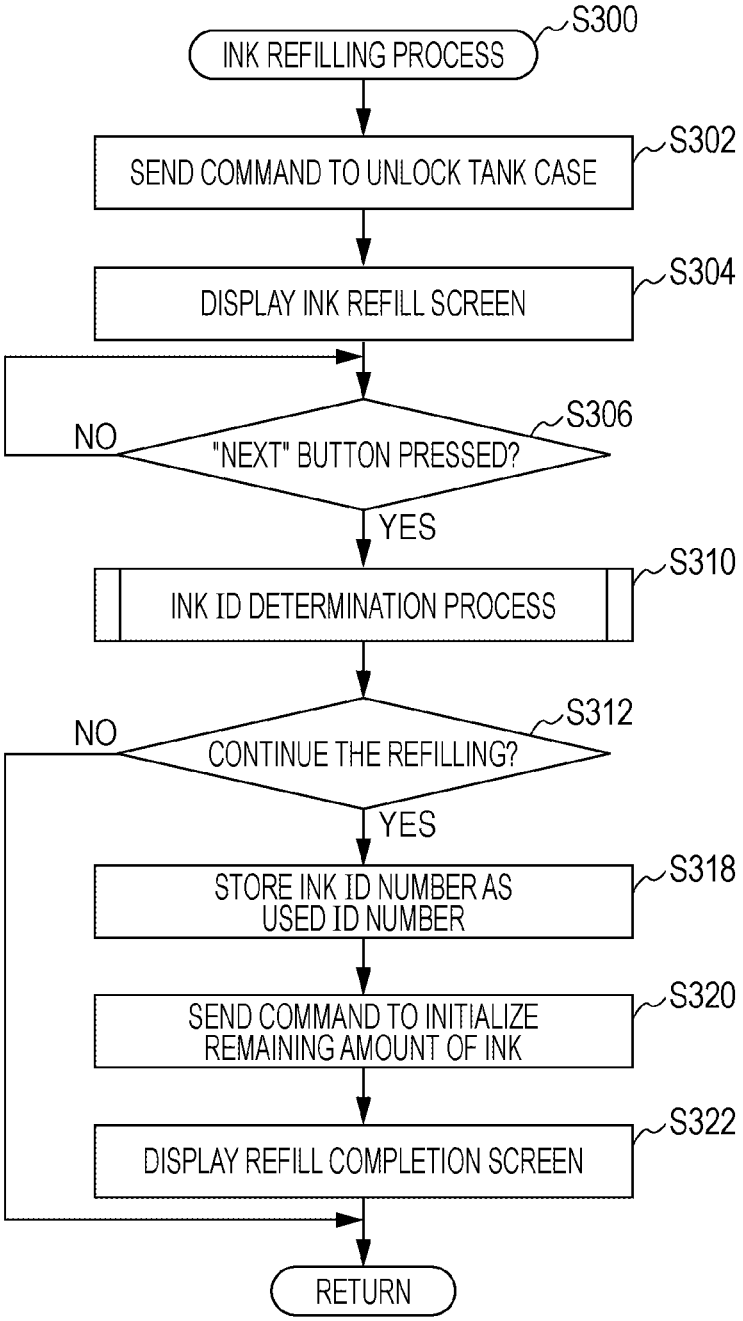
FIG. 3 is a flowchart of an ink refilling process.

FIG. 3 is a flowchart of the ink refilling process. This process is executed by the printer driver 204 in the computer 200 during the remaining ink amount control process. As illustrated in the figure, when the ink refilling process (step S300) starts, a command to unlock the tank case 150 (unlock command) is initially sent to the ink jet printer 100 (step S302). This is because of the following reasons.

As illustrated in FIG. 1, the tank case 150 is separately provided from the ink jet printer 100 and attached on the side face of the ink jet printer 100 when in use. The tank case 150 is usually locked so as not to be removed from the ink jet printer 100. However, the ink tanks 151 in the tank case 150 cannot be refilled with ink when the tank case 150 is in a state in which it is attached to the ink jet printer 100. Accordingly, the computer 200 sends the unlock command to the ink jet printer 100 so that the tank case 150 can be removed before refilling the ink tanks 151 with ink. On receiving the unlock command, the control section 140 of the ink jet printer 100 activates an actuator (not illustrated in the figure) that is mounted in the ink jet printer 100 so that the tank case 150 can be unlocked. As a result, an operator of the ink jet printer 100 can remove the tank case 150.

Figure 5:
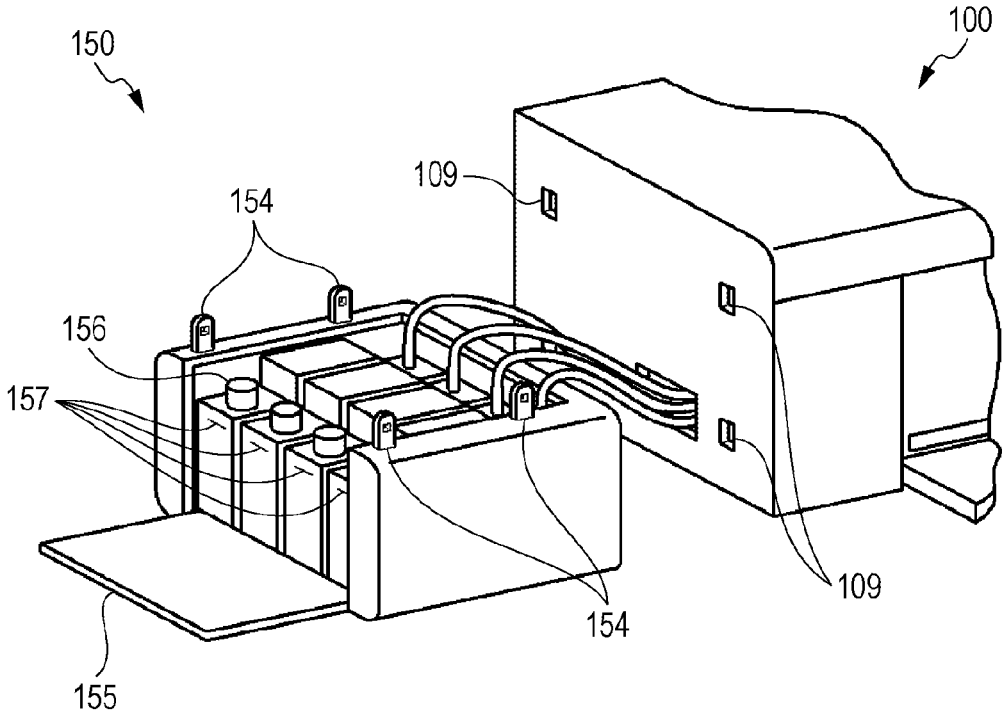
FIG. 5 illustrates a tank case removed from the ink jet printer.

FIG. 5 illustrates the tank case 150 removed from the ink jet printer 100. FIG. 5 illustrates the tank case 150 which has been removed and rotated with the surface to be attached on the ink jet printer 100 facing upward. As illustrated in the figure, four small projections 154 are formed on the surface of the tank case 150 which is to be attached to the ink jet printer 100. Further, insertion holes 109 for the projections 154 are formed at the corresponding positions on the surface of the ink jet printer 100.

When attaching the tank case 150 to the ink jet printer 100, the projections 154 are aligned with the insertion holes 109 and pressed into the insertion holes 109. Each projection 154 has a small through hole formed at the distal end thereof and each insertion hole 109 has a lock mechanism formed therein (not illustrated in the figure). The tank case 150 is attached to the ink jet printer 100 when the through holes and the lock mechanisms are locked together by fitting. Once the tank case 150 is removed, a top cover 155 that is provided on top of the tank case 150 is ready to open. When the top cover 155 is flipped down and uncovers the ink tanks 151 as illustrated in FIG. 5, an upper limit line 157 indicated on the side face of each ink tank 151 can be directly viewed. Further, when the top cover 155 is flipped down after the tank case 150 is rotated as illustrated in FIG. 5, a cap 156 that is located adjacent to the top of the ink tank 151 can be easily removed.

Figure 6:
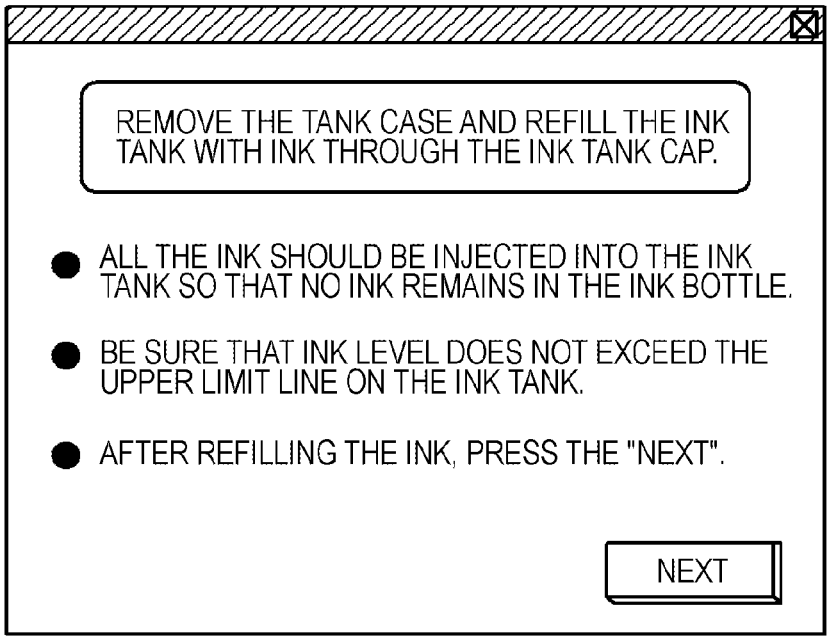
FIG. 6 illustrates an ink refill screen which is displayed on a monitor display.

Referring back to FIG. 3, an ink refill screen is displayed on the monitor display 202 of the computer 200 (step S304). An explanatory view illustrating an ink refill screen which is displayed on the monitor display 202 is illustrated in FIG. 6. As illustrated in the figure, a message appears in the ink refill screen requesting removal of the tank case 150 and refilling of the ink tank 151 through an inlet from which the cap 156 is removed (see FIG. 5). In addition, notifications for refilling of ink are shown below the message, including that all ink in an ink bottle 160 (described later) should be injected into the ink tank 151 and care should be taken so that no ink remains in the ink bottle 160, and the ink level should not exceed an upper limit line 157 (see FIG. 5) that is indicated on the ink tank 151.

Figure 7:
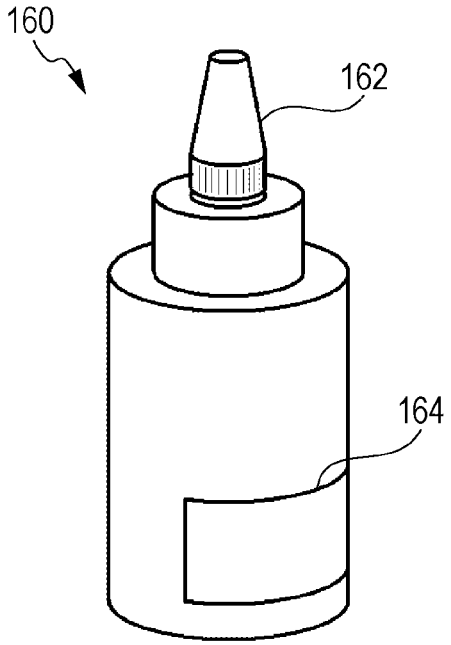
FIG. 7 illustrates an ink bottle which contains a refill ink.

FIG. 7 illustrates the ink bottle 160 which contains a refill ink. The ink bottle 160 is a substantially cylindrical container which is made of a resin material having high air-tightness and light-blocking property and a cap 162 is provided at the top of the container. Further, a paper label 164 is adhered on the side face of the ink bottle 160 such that an ink ID number, that is, an identification code (described later) is printed on the outer surface of the label 164.

In this embodiment, the ink bottle 160 is sealed air-tight with the cap 162 which is affixed to the ink bottle 160. When the ink bottle 160 is opened by twisting off the cap 162, an elongated pouring spout can be accessed. After the tank case 150 is removed as illustrated in FIG. 5, the cap 156 of each ink tank 151 is removed, and then, the ink tank 151 is refilled with ink in the ink bottle 160 through the elongated pouring spout.

It should be noted that, once the ink level in the ink tank 151 has decreased to a predetermined lower limit line, the ink tank 151 is filled again to maximum by injecting all the ink in the ink bottle 160. In addition to that, the cap 162 is simply affixed to the ink bottle 160 and cannot be put back once removed from the ink bottle 160. For the above reasons, notifications are displayed in the ink refill screen of FIG. 6 that all the ink in the ink bottle 160 should be poured out, and accordingly, the operator of the ink jet printer 100 refills the ink tank 151 with all the ink in the ink bottle 160.

Figure 4:
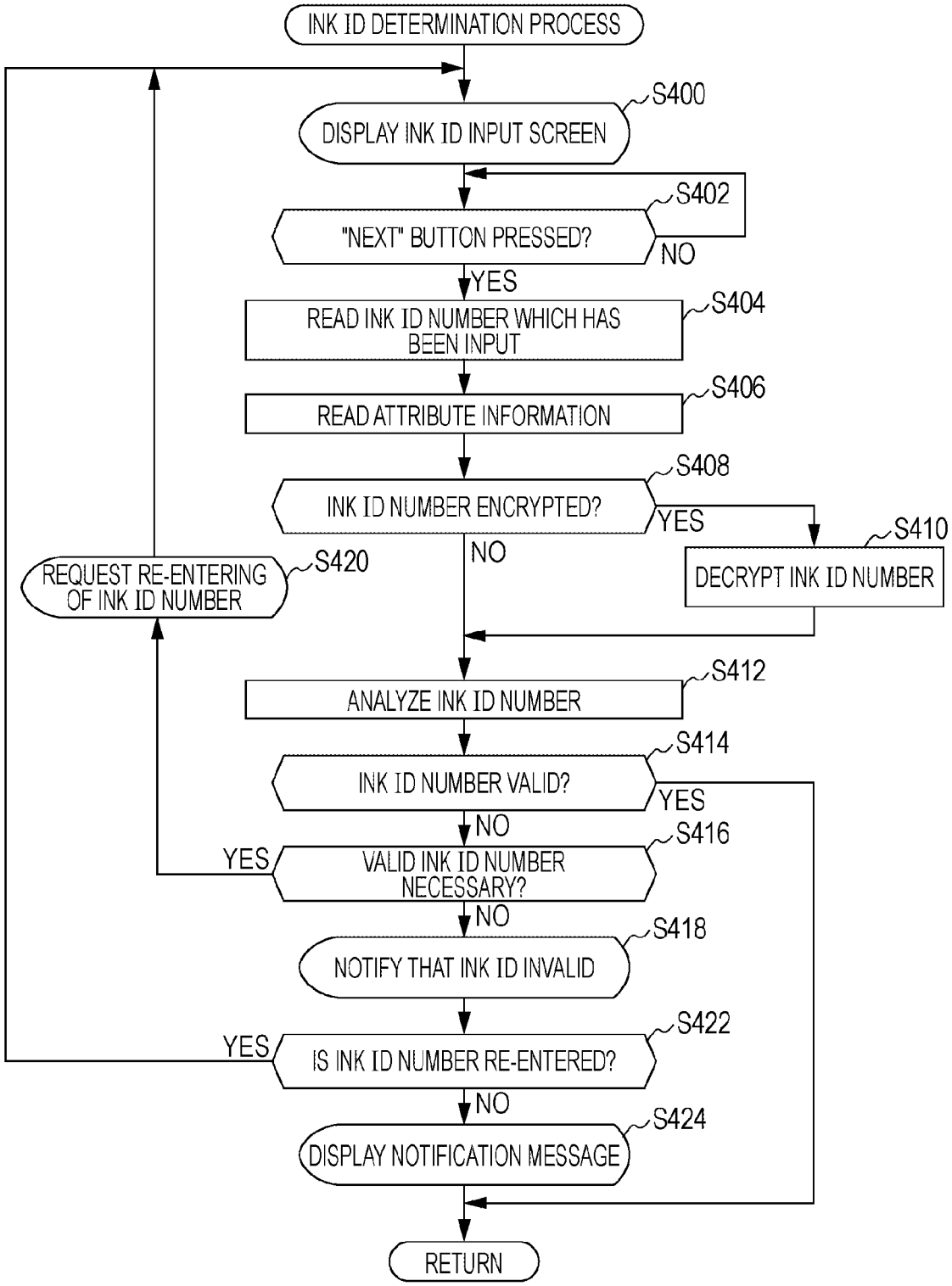
FIG. 4 is a flowchart of an ink ID determining process.

After refilling all of the ink tanks 151 which need to be refilled, the operator of the ink jet printer 100 presses the "next" button which is shown at the lower right corner of the ink refill screen of FIG. 6. The ink refilling process of FIG. 3 is in a stand-by state until the "next" button is pressed (No in step S306). Once, in the process, it is judged that the "next" button is pressed (Yes in step S306), the ink ID determining process (step S310) is executed. FIG. 4 is a flowchart of the ink ID determining process (step S310). When the process starts, a screen is first displayed on the monitor display 202, requesting entering of the ink ID number of the refill ink (step S400).

Figure 8:
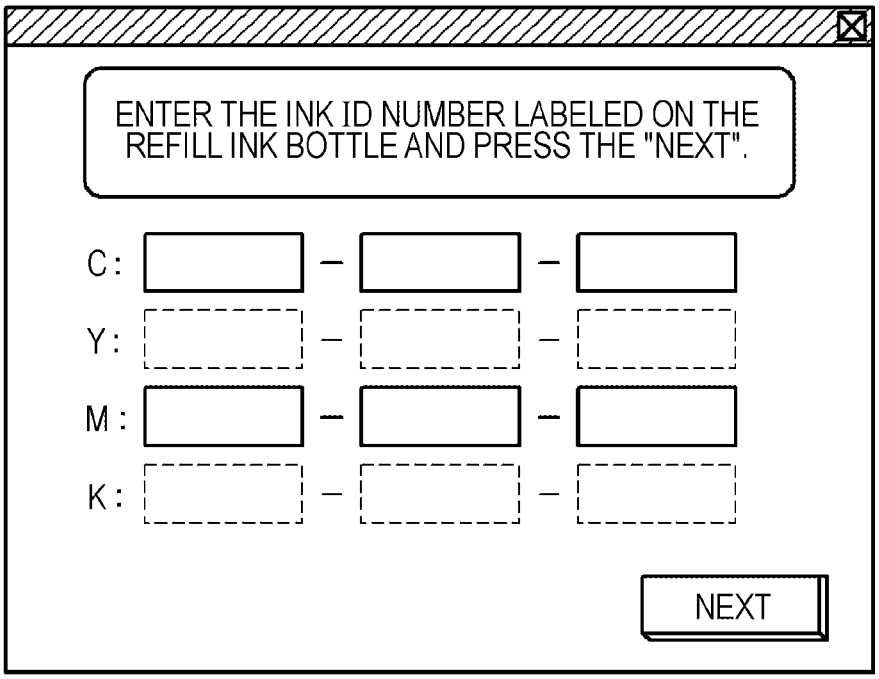
FIG. 8 illustrates an input screen for an ink ID number which is displayed on the monitor display.

FIG. 8 is an explanatory view of an input screen which is one of input units for entering the ink ID number. As illustrated in the figure, an entry field for entering the ink ID number appears in an active state such that the ink ID number of the refill ink, which has been determined to require refilling in the above ink refilling process, can be entered. In the example illustrated in FIG. 8, the entry fields for C ink and M ink appear in an active state such that the ink ID numbers can be entered, while the entry fields for the inks which have been determined to not require refilling (in this case, Y ink and K ink) appear in an inactive state such that the ink ID number cannot be entered. The operator of the ink jet printer 100 checks the label 164 on the ink bottle 160 and enters the ink ID number printed on the outer surface of the label 164, and presses the "next" button which is shown at the lower right corner of the screen.

Then, in the ink ID determining process of FIG. 4, it is judged that the "next" button is pressed (Yes in step S402) and the ink ID number which has been entered (step S404) is read <input function>. Then, the computer 200 communicates with the ink jet printer 100, receives the attribute information 145 which is sent from the ink jet printer 100, and reads the attribute information 145 (step S406) <acquiring function>. Next, in the process, it is determined whether the ink ID number has been encrypted or not on the basis of the attribute information 145 (step S408) <encryption determining function>. The ink ID number is a code composed of a plurality of numeric and alphabetic characters which is seemingly meaningless, however, the code represents data which include information such as a type (color) of ink, time and date (including time units of seconds) at which the ink bottle 160 was filled with ink, and models of the ink jet printer 100 that can accept the ink. The ink ID number is encrypted in a predetermined manner in some cases and not encrypted in other cases. Since the ink ID numbers in both cases have the same number of digits, they cannot be simply identified at a glance. According to the embodiment, the attribute information 145 can include information on whether the ink ID number has been encrypted or not, or whether the ink ID number has been encrypted or not is determined on the basis of information on the destination countries or regions.

Once it is determined that the ink ID number has been encrypted (Yes in step S408), the ink ID number is decrypted (step S410) <decryption function> and the process moves to step S412. Further, if it is determined that the ink ID number has not been encrypted (No in step S408), the process moves to step S412. At step S412, data of the ink ID number which has been read are analyzed (step S412) and it is determined whether the ink ID number is valid or not (step S414) <ink ID number determining function>. In this embodiment, the printer driver 204 in the computer 200 includes pre-stored key data which are necessary for decoding the ink ID number, and the ink ID number which has been read is decoded by using the key data. As a consequence, various information (for example, a type of ink and a model of the ink jet printer 100) is obtained from decoding. If such decoding is appropriately completed, and the obtained information is correct, the ink ID number is determined to be valid.

On the other hand, if the ink ID number cannot be decrypted, or various information obtained from decoding (for example, a type of ink and a model of the ink jet printer 100) is inconsistent with the actual information, the ink ID number is determined to be invalid. In addition, in the case where the ink ID number which has been once used is re-entered, such an ink ID number is regarded as invalid even if the ink ID number is correct.

If the entered ink ID number is determined to be valid (Yes in step S414), the whole process ends. If the entered ink ID number is determined to be invalid (No in step S414), then it is determined whether the valid ink ID number is necessary or not on the basis of the attribute information 145 (step S416). In this embodiment, the processes in step S416, step S418, step S420, step S422 and step S424 correspond to the selection/execution function.

Figure 9:
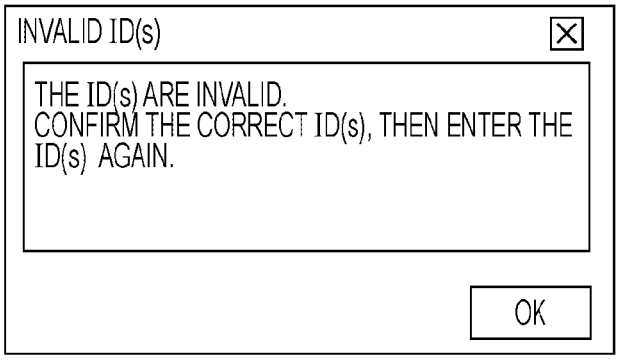
FIG. 9 illustrates a notification that requests re-entering of the ink ID number.

Moreover, in this embodiment, whether a valid ink ID number is necessary or not is determined in accordance with the destination countries or regions, which is part of the attribute information 145. If a valid ink ID number is determined to be necessary (Yes in step S416), a message appears requesting re-entering of the ink ID number, as illustrated in FIG. 9 (step S420), and the process returns to step S400. It should be noted that the language of the message is not limited to Japanese or English, and may correspond to languages of the destination countries or regions.

Figure 10:
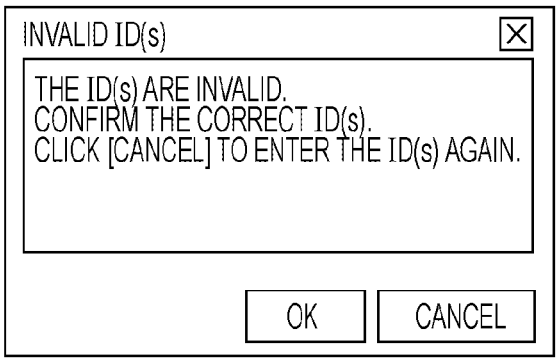
FIG. 10 illustrates a notification that the ink ID is invalid.

On the other hand, if a valid ink ID number is determined to be unnecessary (No in step S416), a notification is provided that the ink ID number is invalid, as illustrated in FIG. 10 (step S418), and in response to the operation by the operator, whether the ink ID number is re-entered or not is judged (step S422).

Figure 11:
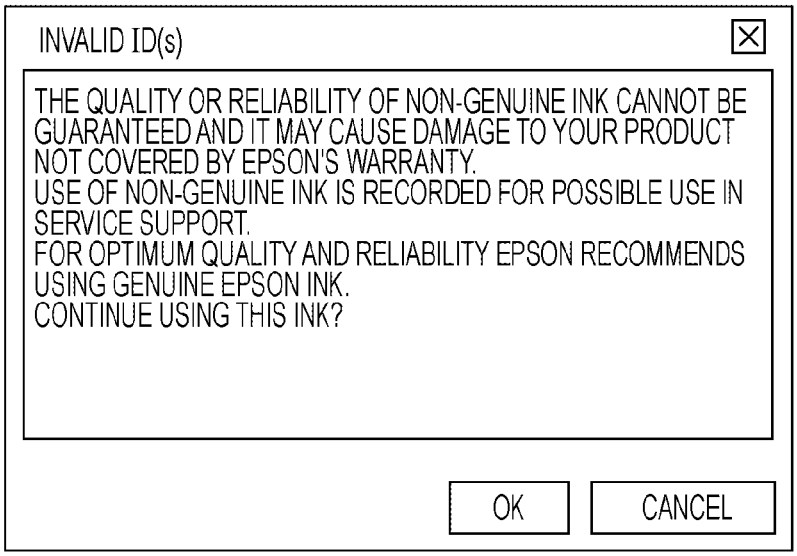
FIG. 11 illustrates a notification that printing with a non-genuine ink may decrease printing quality.

Then, if it is judged that the ink ID number is re-entered (Yes in step S422), the process returns to step S400. Alternatively, if it is judged that the ink ID number is not re-entered (No in step S422), a notification is provided that printing with a non-genuine ink may decrease printing quality, as illustrated in FIG. 11 (step S424), and the whole process ends.

Referring back to FIG. 3, it is judged whether the refilling process is continued or not (step S312). In this embodiment, if the ink ID number is determined to be valid in step S414 of the ink ID number determining process and the OK button is pressed in the notification in step S424 (FIG. 11), it is judged that the refilling process is continued. On the other hand, if the cancel button is pressed in step S424 (FIG. 11), it is judged that the refilling process is not continued. If it is judged that the refilling process is continued (Yes in step S312), the process goes to step S318. On the other hand, if it is judged that the refilling process is not continued (No in step S312), the whole process ends.

At step S318, the ink ID number determined to be valid is stored as a used ID number in the RAM of the computer 200. Such used ID numbers are referred to during the process so as to determine whether the ink ID number is valid or not (step S414) during subsequent operations. Even if the entered ink ID number is appropriately decoded and the decoded information has no discrepancy, the ink ID number which is stored as a used ID number is regarded as invalid. Next, the printer driver 204 sends a command to the control section 140 of the ink jet printer 100 to initialize the value of the remaining ink amount calculated by the control section 140 of the ink jet printer 100 and to reset the value to a maximum level (step S320). Then, a refill completion screen (not illustrated in the figure), which provides a notification that the refilling of ink is completed, is displayed on the monitor display 202 (step S322), and the whole ink refilling process ends.

The above-mentioned embodiment has the following advantages:

(1) Processes of the printer driver 204 are decided on the basis of the attribute information 145 including the destination country or region where it is to be used, which is held in the ink jet printer 100. Such processes can be decided through the user's operation for each destination country or region. Therefore, one printer driver 204 can correspond to a plurality of destination countries or regions.

(2) Even if the ink ID number is encrypted depending on the destination country or region, the printer driver 204 can decrypt the ink ID number on the basis of the attribute information 145. Further, the above-mentioned technique may be performed by a single device or a combination of two or more devices, and may be executed in various modifications. For example, in the foregoing embodiment, processes for dealing with a non-genuine ink during refilling of ink are described as two options corresponding to whether a valid ink ID number is necessary or not. However, such options are not limited to those described in the foregoing embodiment, and further processes of a plurality of steps may be included according to the destination country or region.

What is claimed is:

1. A printer control device that controls operations of a printing apparatus which is configured to be refilled with ink from the outside, comprising:

an acquiring module configured to acquire geographical information indicative of a destination country or region where the printing apparatus is to be used;

an input module configured to acquire an ink identification code which is assigned to the ink that is to be refilled;

an ink determining module configured to determine whether the ink is a genuine ink or a non-genuine ink, by analyzing the ink identification code; and a selection/execution module configured to select one of a plurality of processes for the non-genuine ink on the basis of the geographical information, if the ink is determined to be the non-genuine ink, and to execute the selected process.

2. The printer control device according to claim 1, wherein the selection/execution module is further configured to:

determine whether the genuine ink is necessary or not on the basis of the geographical information, request a user to re-enter the ink identification code if the genuine ink is determined to be necessary, and a notification that the ink to be refilled is not genuine if the genuine ink is determined not to be necessary.

3. The printer control device according to claim 2, wherein, the selection/execution module is further configured to judge whether the ink identification code is to be re-entered or not if the genuine ink is determined to be unnecessary, and to provide a notification that printing with the non-genuine ink may decrease printing quality if the ink identification code is not re-entered.

4. The printer control device according to claim 1, further comprising:

an encryption determining module configured to determine whether the ink identification code has been encrypted or not on the basis of the geographical information, and a decrypting module configured to decrypt the ink identification code to be analyzable if the ink identification code is determined to have been encrypted.

5. A printing system comprising:

a printing apparatus which is configured to be refilled with ink from outside; and a printer control device that controls operations of the printing apparatus, wherein the printing apparatus and the printer control device are communicatively connected with each other, the printing apparatus comprising a holding unit that holds geographical information indicative of a destination country or region where the printing apparatus is to be used, and a transmission unit that transmits the geographical information to the printer control device, the printer control device comprising:

receiving unit that receives the attribute an acquiring module configured to acquire the geographical information sent from the printing apparatus;

an input module configured to acquire an ink identification code which is assigned to the ink that is to be refilled;

an ink determining module configured to determine whether the ink is a genuine ink or a non-genuine ink, by analyzing the ink identification code; and a selection/execution module configured to select one of a plurality of processes for the non-genuine ink on the basis of the geographical information, if the ink is determined to be the non-genuine ink, and to execute the selected process.

6. A method for controlling a printer, the method controlling operations of a printing apparatus which is configured to be refilled with ink from the outside, and causing a computer to execute a process comprising:

acquiring geographical information indicative of a destination country or region where the printing apparatus is to be used by using an acquiring module;

acquiring an ink identification code which is assigned to the ink that is to be refilled by using an input module;

determining whether the ink is a genuine ink or a non-genuine ink, by analyzing the ink identification code by using an ink determining module; and selecting one of a plurality of processes for the non-genuine ink on the basis of the geographical information, if the ink is determined to be net-genuine the non-genuine ink and executing the selected process.

7. A recording medium storing a program for controlling operations of a printing apparatus which is configured to be refilled with ink from the outside, the program causing a computer to execute:

an acquiring module configured to acquire geographical information indicative of a destination country or region where the printing apparatus is to be used;

an input module configured to acquire an ink identification code which is assigned to the ink that is to be refilled;

an ink determining module configured to determine whether the ink is a genuine ink or net a genuine ink, by analyzing the ink identification code; and a selection/execution module configured to select one of a plurality of processes for the non-genuine ink on the basis of the geographical information, if the ink is determined to be the non-genuine ink, and to execute the selected process.

* * * * *